US009188390B2

(12) United States Patent
Yu

(10) Patent No.: US 9,188,390 B2
(45) Date of Patent: Nov. 17, 2015

(54) ALUMINUM-BASED MATERIAL MELTING APPARATUS

(71) Applicant: Chai-Long Yu, Taichung (TW)

(72) Inventor: Chai-Long Yu, Taichung (TW)

( * ) Notice: Subject to any disclaimer, the term of this patent is extended or adjusted under 35 U.S.C. 154(b) by 390 days.

(21) Appl. No.: 13/752,725

(22) Filed: Jan. 29, 2013

(65) Prior Publication Data

US 2014/0054832 A1 Feb. 27, 2014

(30) Foreign Application Priority Data

Aug. 23, 2012 (TW) ..... 101130646 A

(51) Int. Cl.

| | |
|---|---|
| ***F27D 3/14*** | (2006.01) |
| ***F27B 14/06*** | (2006.01) |
| ***F27B 14/08*** | (2006.01) |
| ***F27B 14/20*** | (2006.01) |

(52) U.S. Cl.

CPC . *F27D 3/14* (2013.01); *F27B 14/06* (2013.01); *F27B 14/08* (2013.01); *F27B 14/20* (2013.01)

(58) Field of Classification Search

CPC ..... F27B 14/06; F27B 14/08; F27B 14/20; F27B 7/00; F27B 7/32; F27D 3/14

USPC ..... 266/236; 222/591, 629; 164/136, 336

See application file for complete search history.

(56) References Cited

U.S. PATENT DOCUMENTS

| | | | | |
|---|---|---|---|---|
| 3,070,437 A | | 12/1962 | Bacheldor | |
| 3,398,782 A | * | 8/1968 | Lauterjung | 164/336 |
| 4,741,514 A | * | 5/1988 | Bleickert | 266/239 |
| 4,891,204 A | * | 1/1990 | Robinson | 423/495 |
| 5,131,452 A | * | 7/1992 | Bilz et al. | 164/136 |
| 5,341,394 A | * | 8/1994 | Nicetto | 373/115 |

FOREIGN PATENT DOCUMENTS

| | | | | |
|---|---|---|---|---|
| CN | 1175681 A | | 3/1998 | |
| CN | 1324444 A | | 11/2001 | |
| CN | 1091871 C | | 10/2002 | |
| CN | 1447728 A | | 10/2003 | |
| CN | 101073828 | * | 11/2007 | B22D 39/02 |
| CN | 101073828 A | | 11/2007 | |
| CN | 201672799 U | | 12/2010 | |
| JP | S61-205654 | | 12/1986 | |
| TW | 460584 | | 10/2001 | |

OTHER PUBLICATIONS

The Search Report appended in an Office Action that issued to Taiwanese Counterpart Application No. 101130346 on Jun. 12, 2014 along with an English translation thereof.

(Continued)

*Primary Examiner* — Scott Kastler
*Assistant Examiner* — Michael Aboagye
(74) *Attorney, Agent, or Firm* — Vedder Price, P.C.

(57) ABSTRACT

An aluminum-based material melting apparatus includes: a furnace; a melt-discharging conduit having an inner portion disposed in the furnace; a driving mechanism mounted on the furnace; a transmission mechanism connected to the driving mechanism; and a scoop member suspended in the furnace and driven by the driving mechanism through the transmission mechanism so as to be movable in the furnace between upper and lower positions and so as to be rotatable relative to the furnace about an axis between scooping and pouring positions.

4 Claims, 9 Drawing Sheets

(56) References Cited

OTHER PUBLICATIONS

The Search Report appended in an Office Action that issued to Taiwanese Counterpart Application No. 101130646 on Jun. 12, 2014 along with an English translation thereof.

Search Report issued in Chinese Application No. 201210442543.X by the State Intellectual Property Office of the P.R.C. on Feb. 4, 2015; 6 pages.

* cited by examiner

ALUMINUM-BASED MATERIAL MELTING APPARATUS

CROSS-REFERENCE TO RELATED APPLICATION

This application claims priority of Taiwanese Application No. 101130646, filed on Aug. 23, 2012.

BACKGROUND OF THE INVENTION

1. Field of the Invention

This invention relates to an aluminum-based material melting apparatus, more particularly to an aluminum-based material melting apparatus including a scoop member that is movable upwardly and downwardly and that is rotatable in a furnace for scooping and pouring an aluminum-based melt.

2. Description of the Related Art

U.S. Pat. No. 3,070,437 discloses a rotary furnace for melting aluminum in a molten salt on a continuous operation basis. The rotary furnace includes a furnace body and a plurality of scoops formed on an inner wall of the furnace body and rotatable together with the furnace body for scooping an aluminum melt in the furnace body. A collecting member extends into the furnace body for collecting the aluminum melt spilled from the scoops. A feed hopper is connected to the rotary furnace through a feed conduit that extends into the furnace body for delivering aluminum solids into the furnace body.

SUMMARY OF THE INVENTION

An object of the present invention is to provide an aluminum-based material melting apparatus that is energy saving and that can directly deliver a controllable amount of an aluminum-based melt to a casting die.

According to this invention, there is provided an aluminum-based material melting apparatus that comprises: a furnace defining a furnace space and adapted to accommodate an aluminum-based melt in the furnace space; a melt-discharging conduit having an inner portion disposed in the furnace space, and an outer portion disposed outwardly of the furnace space, the inner portion being adapted to be disposed above a surface of the aluminum-based melt in the furnace space; a driving mechanism mounted on the furnace; a transmission mechanism connected to the driving mechanism; and a scoop member suspended in the furnace space and driven by the driving mechanism through the transmission mechanism so as to be movable upwardly and downwardly in the furnace space between upper and lower positions and so as to be rotatable relative to the furnace about an axis between scooping and pouring positions so that the scoop member can scoop the aluminum-based melt when disposed at the lower position and the scooping position and that the scoop member can pour the aluminum-based melt into the inner portion of the melt-discharging conduit when disposed at the upper position and the pouring position.

BRIEF DESCRIPTION OF THE DRAWINGS

In drawings which illustrate an embodiment of the invention.

DETAILED DESCRIPTION OF THE PREFERRED EMBODIMENT

Figure 1:
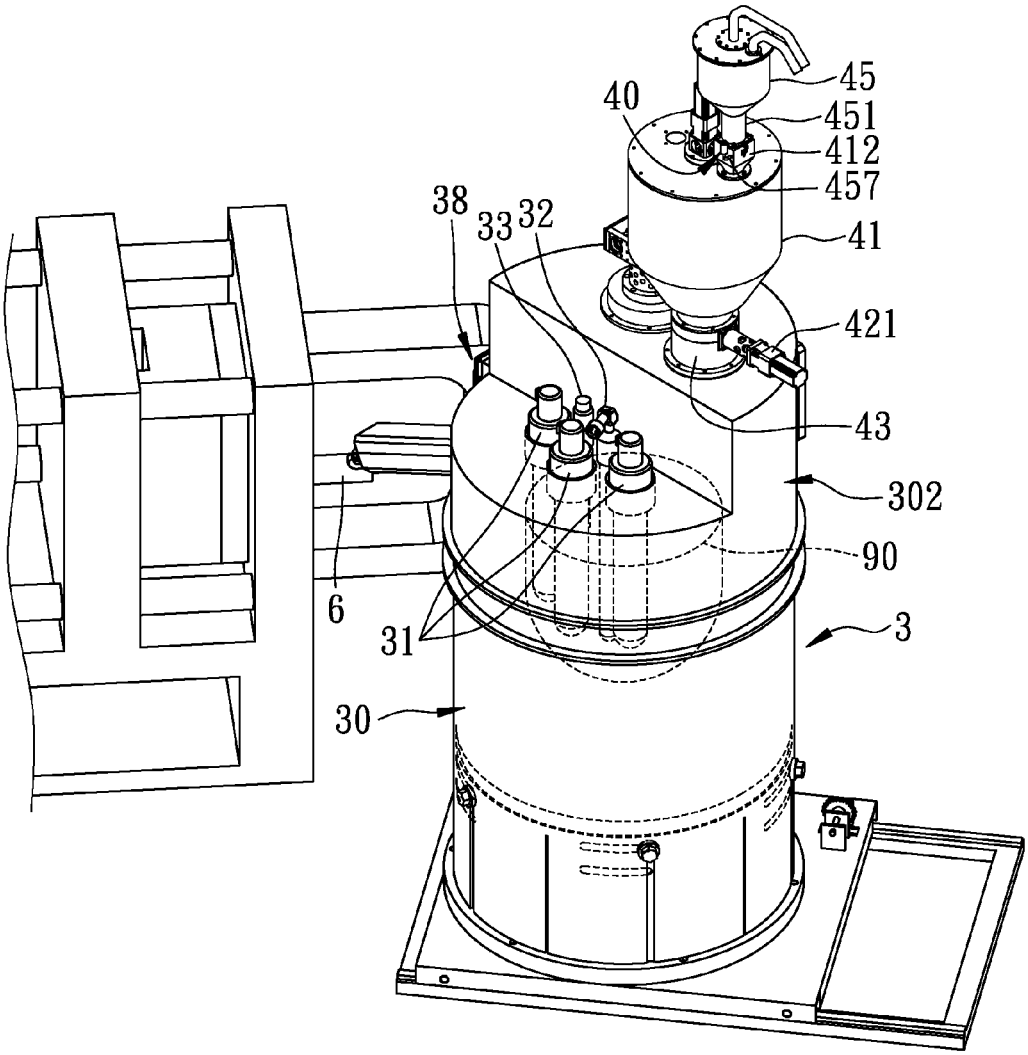
FIG. 1 is a perspective view of the preferred embodiment of an aluminum-based material melting apparatus according to the present invention.

FIGS. 1 to 4 illustrate the preferred embodiment of an aluminum-based material melting apparatus according to the present invention. The aluminum-based material melting apparatus includes a furnace 3, a plurality of heating elements 31, a temperature sensor 32, a melt level sensor 33, a melt-discharging conduit 38, a driving mechanism, a transmission mechanism, a scoop member 52, a preheating funnel 41, an inlet conduit 43, a horizontal conveying shaft 42, a discharging tube 422, a vertical screw feeder shaft 461, a plurality of perforated hollow pillars 44, a stirrer 46, a feed hopper 45, a material outlet conduit 451, and a weight-controlling valve mechanism 40. The feed hopper 45 stores an aluminum-based raw material (not shown) therein. Preferably, the aluminum-based raw material is in the form of aluminum or aluminum alloy particles. The driving mechanism includes first and second driving motors 511, 512. The transmission mechanism includes first and second shafts 516, 517, a worm wheel 514, a worm 515, a linking shaft 523 that defines a first axis (X), a rack 513 and a pinion 519.

The furnace 3 includes a main body 30 and a furnace cover 302 which covers a top opening of the main body 30 and which cooperates with the main body 30 to define a furnace space 305 for accommodating an aluminum-based melt 90 therein. The melt-discharging conduit 38 has an inner portion 381 disposed in the furnace space 305, and an outer portion 383 disposed outwardly of the furnace space 305 and cooperating with the inner portion 381 to define a melt passage 384 for passage of the aluminum-based melt 90 therethrough. The inner portion 381 is disposed above a surface of the aluminum-based melt 90 in the furnace space 305.

The heating elements 31 and the temperature sensor 32 are mounted on the furnace cover 302, extend into the furnace space 305, and each is partially immersed in the aluminum-based melt 90. The heating elements 31 are electrically powered to generate heat to melt the aluminum-based raw material received in the furnace space 305 under a melting temperature of above 680° C. A temperature controller (not shown) is connected to the temperature sensor 32 and the heating elements 31 to control power on and off states of the heating elements 31 based on a temperature signal generated by the temperature sensor 32. The melt level sensor 33 is mounted on the furnace 3 for detecting the level of the aluminum-based melt 90. The driving mechanism and the transmission mechanism are mounted on the furnace cover 302 of the furnace 3.

Figure 5:
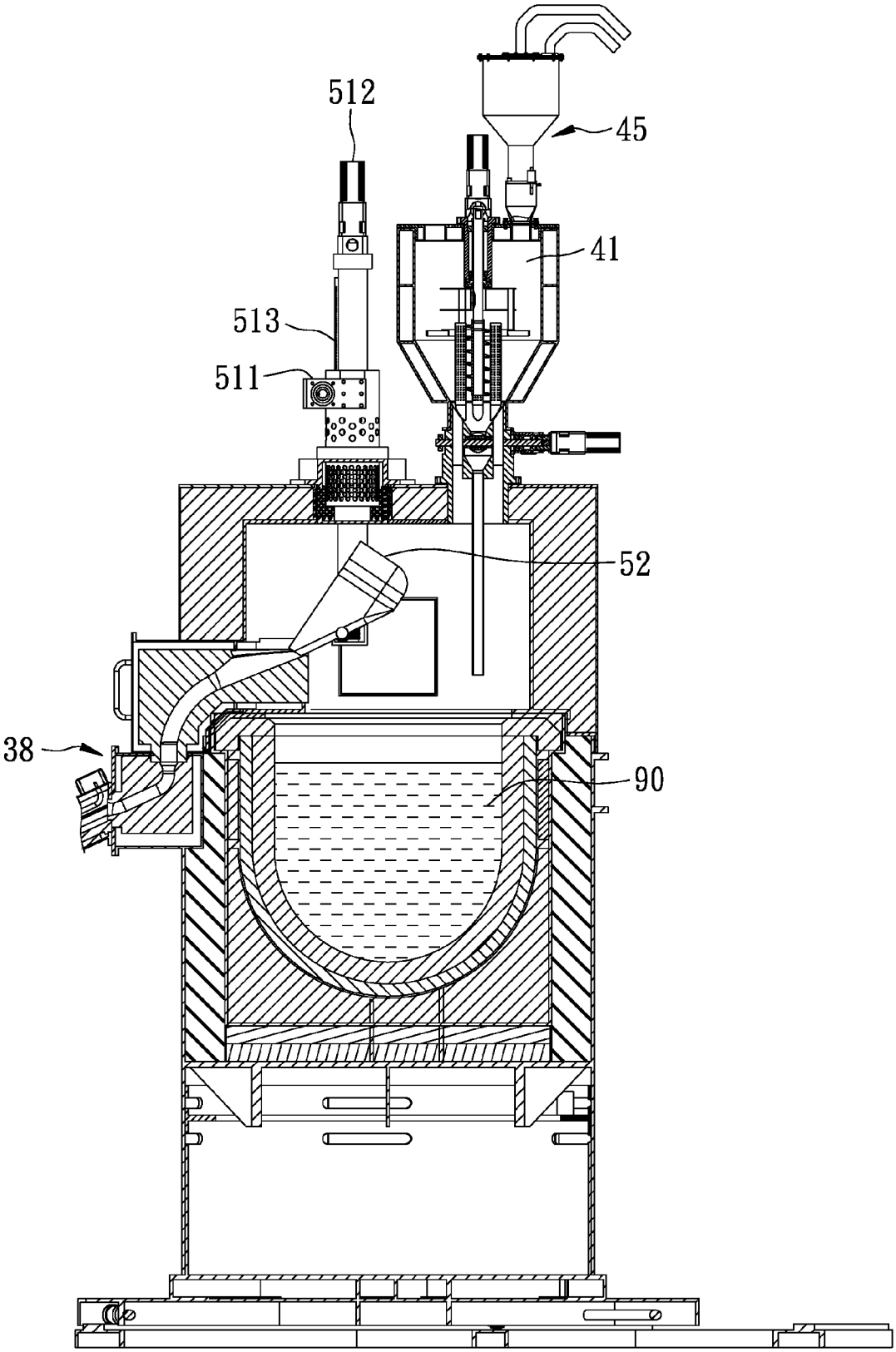
FIG. 5 is a sectional view illustrating another state where the scoop member is disposed at a pouring position.

The scoop member 52 is suspended in the furnace space 305, and is driven by the driving mechanism through the transmission mechanism so as to be movable upwardly and downwardly in the furnace space 305 between upper and lower positions (see FIGS. 5 and 2) and so as to be rotatable relative to the furnace 3 about the first axis (X) between scooping and pouring positions (see FIGS. 2 and 5) so that the scoop member 52 can scoop the aluminum-based melt 90 when disposed at the lower position and the scooping position (see FIG. 2) and that the scoop member 52 can pour the aluminum-based melt 90 into the inner portion 381 of the melt-discharging conduit 38 when disposed at the upper position and the pouring position (see FIG. 5), thereby permitting discharging of the aluminum-based melt 90 from the furnace space 305 into a casting mold 6.

In this embodiment, the first and second shafts 516, 517 are mounted movably on the furnace 3, extend through the furnace cover 302, and are coaxially disposed with respect to a second axis (Y) which is perpendicular to the first axis (X). The second shaft 517 is disposed in the first shaft 516, and is coupled rotatably to the first shaft 516 through a bearing set (not shown).

The first driving motor 511 has an output shaft 518. The rack 513 is secured to the first shaft 516. The pinion 519 is coaxially and securely sleeved on the output shaft 518, and meshes with the rack 513 for driving co-movement of the first and second shafts 516, 517 along the second axis (Y) when the first driving motor 511 is actuated. The second driving motor 512 drives rotation of the second shaft 517 relative to the first shaft 516 about the second axis (Y). The worm 515 is secured to the second shaft 517. The linking shaft 523 is secured to a bottom of the scoop member 52. The worm wheel 514 is secured to the linking shaft 523, and meshes with the worm 515 for driving rotation of the scoop member 52 relative to the first shaft 516 about the first axis (X) when the second driving motor 512 is actuated. A motor controller (not shown) is connected to the second driving motor 512 for controlling the rotational angle of the scoop member 52 so that the amount of the aluminum-based melt 90 scooped into the scoop member 52 can be controlled.

The preheating funnel 41 is disposed above and is mounted on the furnace cover 302 of the furnace 3, defines a funnel space 410 for receiving the aluminum-based raw material from the feed hopper 45, and has an inlet port 412 for passage of the aluminum-based raw material, delivered from the feed hopper 45, therethrough and into the funnel space 410. The vertical screw feeder shaft 461 is disposed rotatably in the funnel space 410 for driving downward movement of the aluminum-based raw material in the funnel space 410.

The inlet conduit 43 interconnects the preheating funnel 41 and the furnace 3, and has an annular upper portion 432 and an annular lower portion 433 that extends downwardly from the upper portion 432 through a top inlet hole 303 in the furnace cover 302. The upper portion 432 of the inlet conduit 43 has an inner wall surface that defines a central space 430 in fluid communication with the furnace space 305 and the funnel space 410 for passage of the aluminum-based raw material, delivered from the funnel space 410, therethrough and into the furnace space 305.

Figure 2:
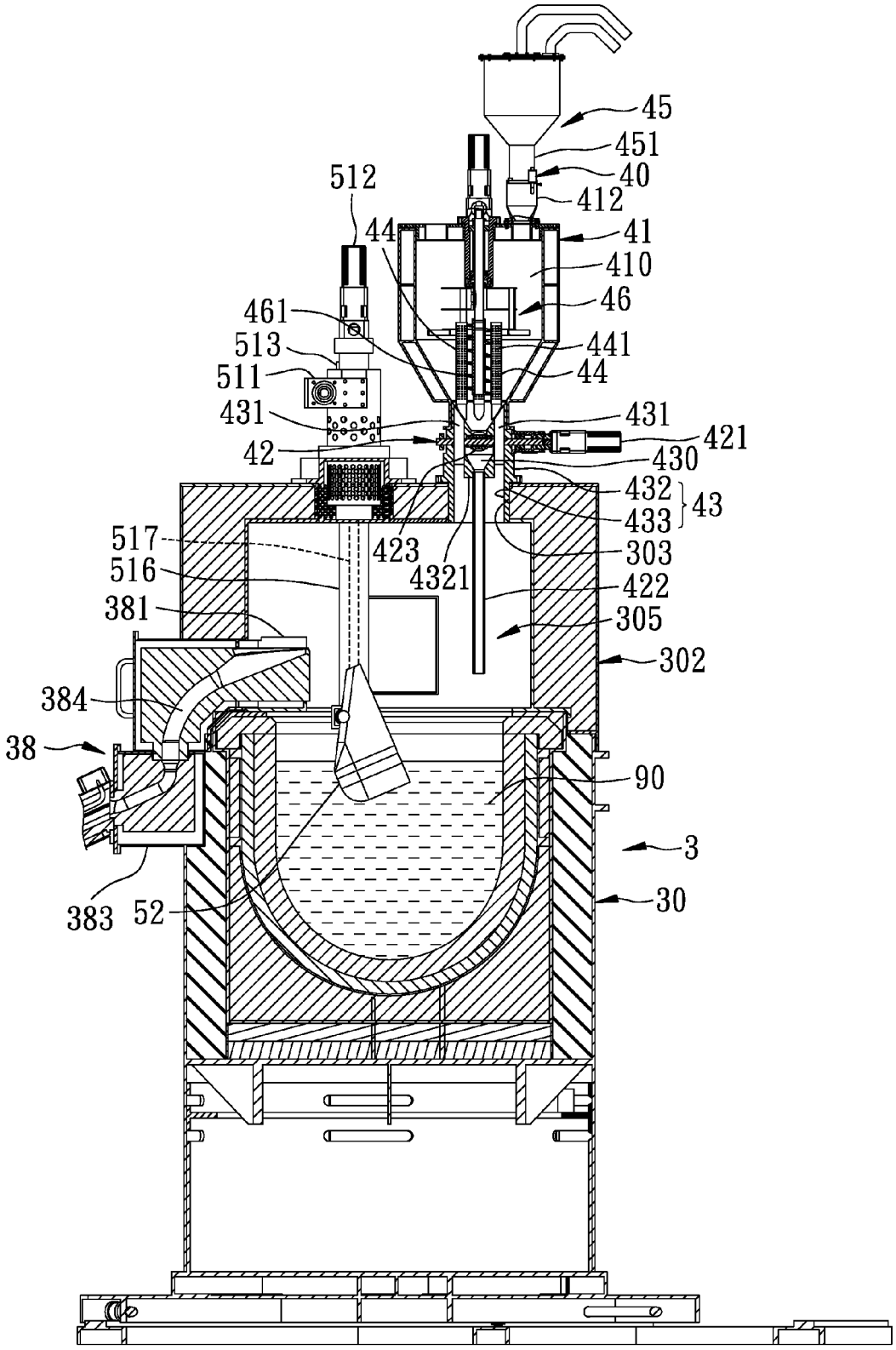
FIG. 2 is a sectional view of the preferred embodiment, illustrating a scoop member at a scooping position.
Figure 3:
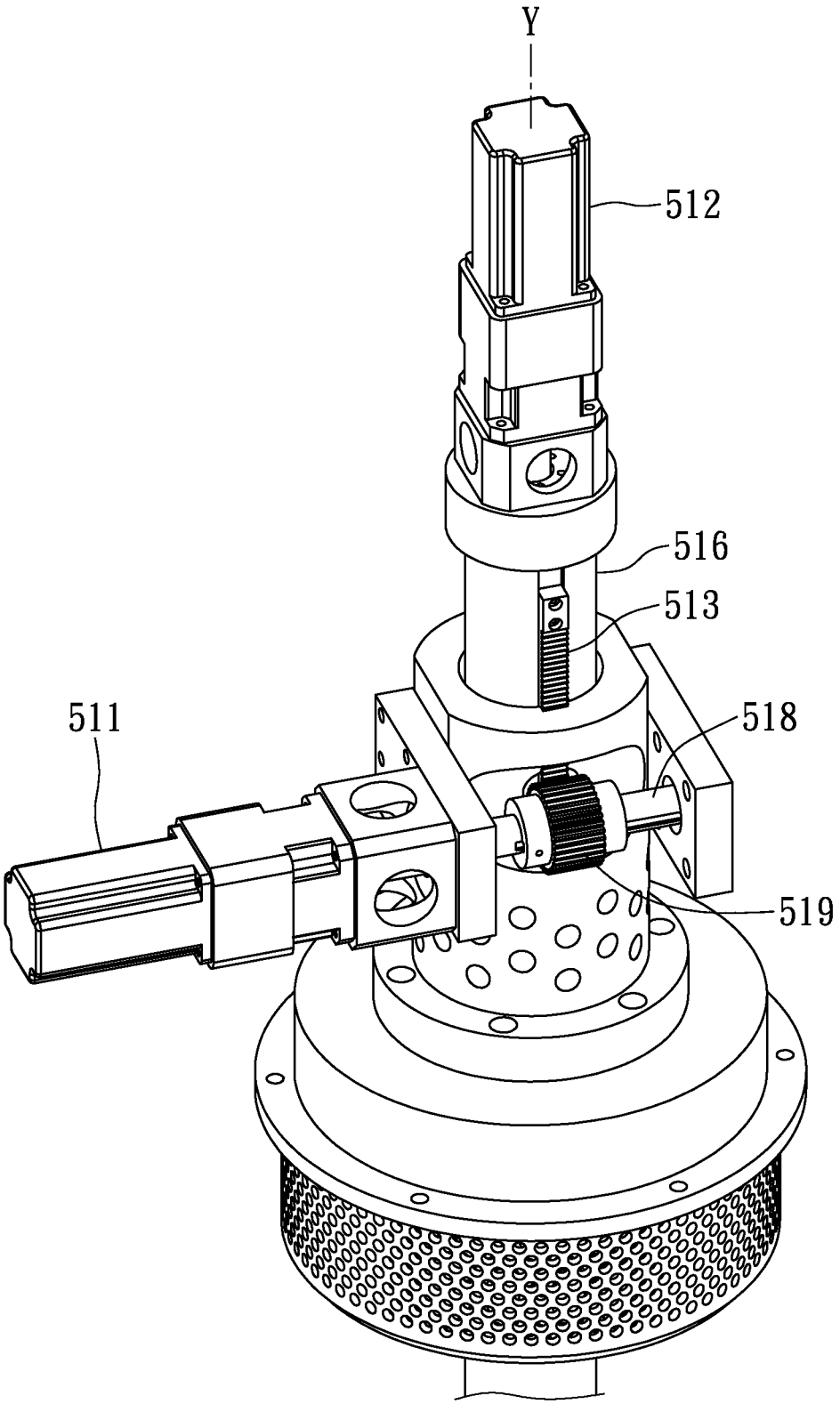
FIG. 3 is a perspective view of a driving mechanism and an assembly of a rack and a pinion of the preferred embodiment.
Figure 4:
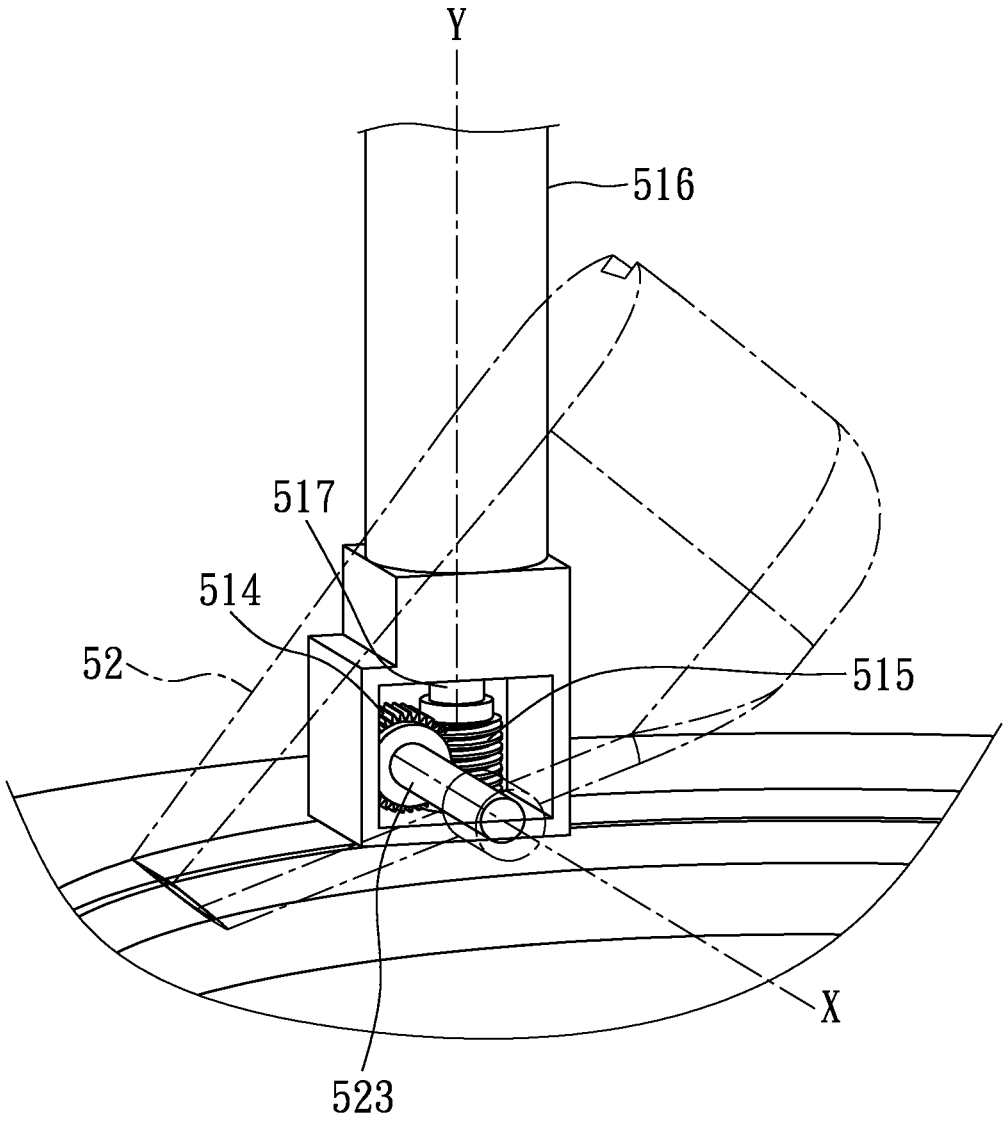
FIG. 4 is a perspective view of an assembly of first and second shafts, a worm, a worm wheel and the scoop member of the preferred embodiment.
Figure 6:
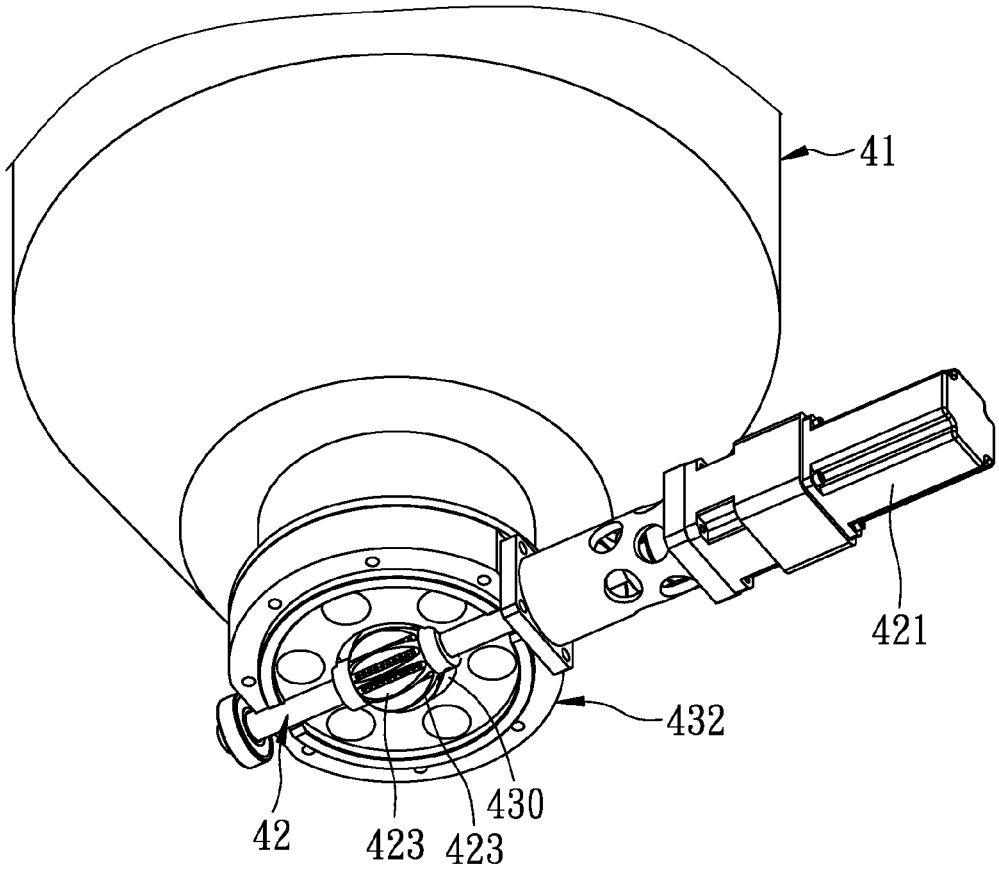
FIG. 6 is a fragmentary perspective view of an assembly of a preheating funnel, an inlet conduit, a motor, and a horizontal conveying shaft of the preferred embodiment.
Figure 7:
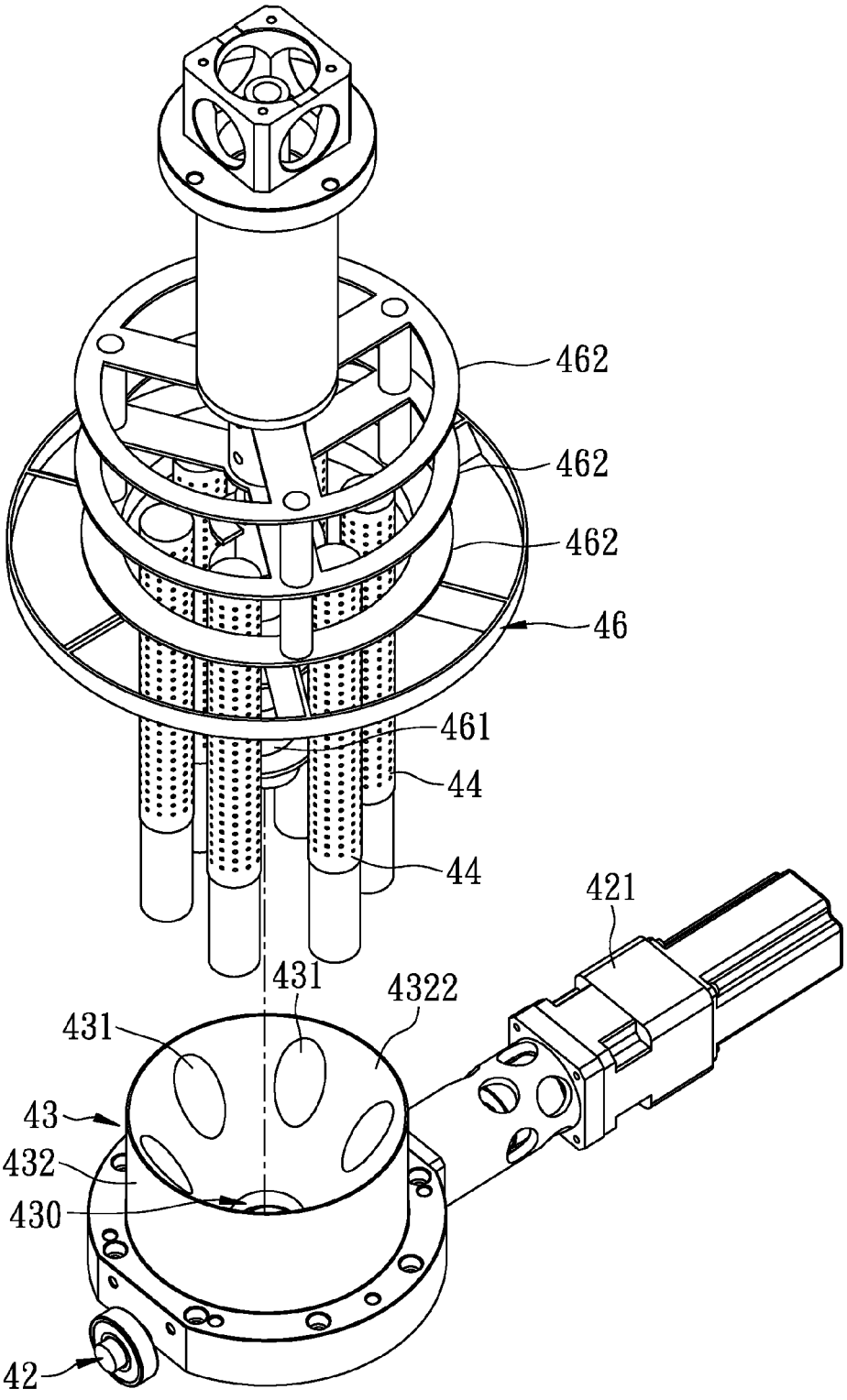
FIG. 7 is a partly exploded perspective view of an assembly of the inlet conduit, the motor, the horizontal conveying shaft, perforated hollow pillars and a stirrer of the preferred embodiment.

Referring to FIGS. 6 and 7, in combination with FIG. 2, the horizontal conveying shaft 42 extends transversely through the upper portion 432 of the inlet conduit 43, is driven by a third driving motor 421 to rotate about its axis relative to the inlet conduit 43, and is formed with a plurality of radially extending blades 423 that protrude therefrom into the central space 430 for conveying the aluminum-based raw material from the central space 430 into the furnace space 305 when the horizontal conveying shaft 42 rotates about its axis.

The upper portion 432 of the inlet conduit 43 is connected to the preheating funnel 41, has a truncated conical top surface 4322 (see FIG. 7), and is formed with a plurality of axial holes 431 that extend axially along the length of the upper portion 432 through the top surface 4322, and that are angularly displaced from one another to surround the central space 430. The perforated hollow pillars 44 are disposed in the funnel space 410, are angularly displaced from one another to surround the vertical screw feeder shaft 461, extend respectively in a vertical direction into the axial holes 431 in the upper portion 432 of the inlet conduit 43, and each is formed with a plurality of through-holes 441 in fluid communication with the funnel space 410, thereby permitting fluid flow of a hot gas, arisen from the furnace space 305 and through the axial holes 431, therethrough and into the funnel space 410 to preheat the aluminum-based raw material in the funnel space 410 and to remove moisture from the aluminum-based raw material. The aluminum-based raw material in the funnel space 410 can be preheated to a temperature ranging from 450° C. to 550° C. by the fluid flow of the hot gas and radiation heat radiated from the aluminum-based melt 90 and the heating elements 31.

The discharging tube 422 extends downwardly along the axis of the vertical screw feeder shaft 461 from a bottom end 4321 of the upper portion 432 through the lower portion 433 of the inlet conduit 43 and into the furnace space 305, and is in spatial communication with the central space 430 for passage of the aluminum-based raw material therethrough and into the furnace space 305.

The stirrer 46 is disposed in the funnel space 410 above the vertical screw feeder shaft 461, and has a plurality of annular blades 462 (see FIG. 7) for stirring the aluminum-based raw material in the funnel space 410 for facilitating conveying of the aluminum-based raw material from the funnel space 410 to the furnace space 305.

Figure 8:
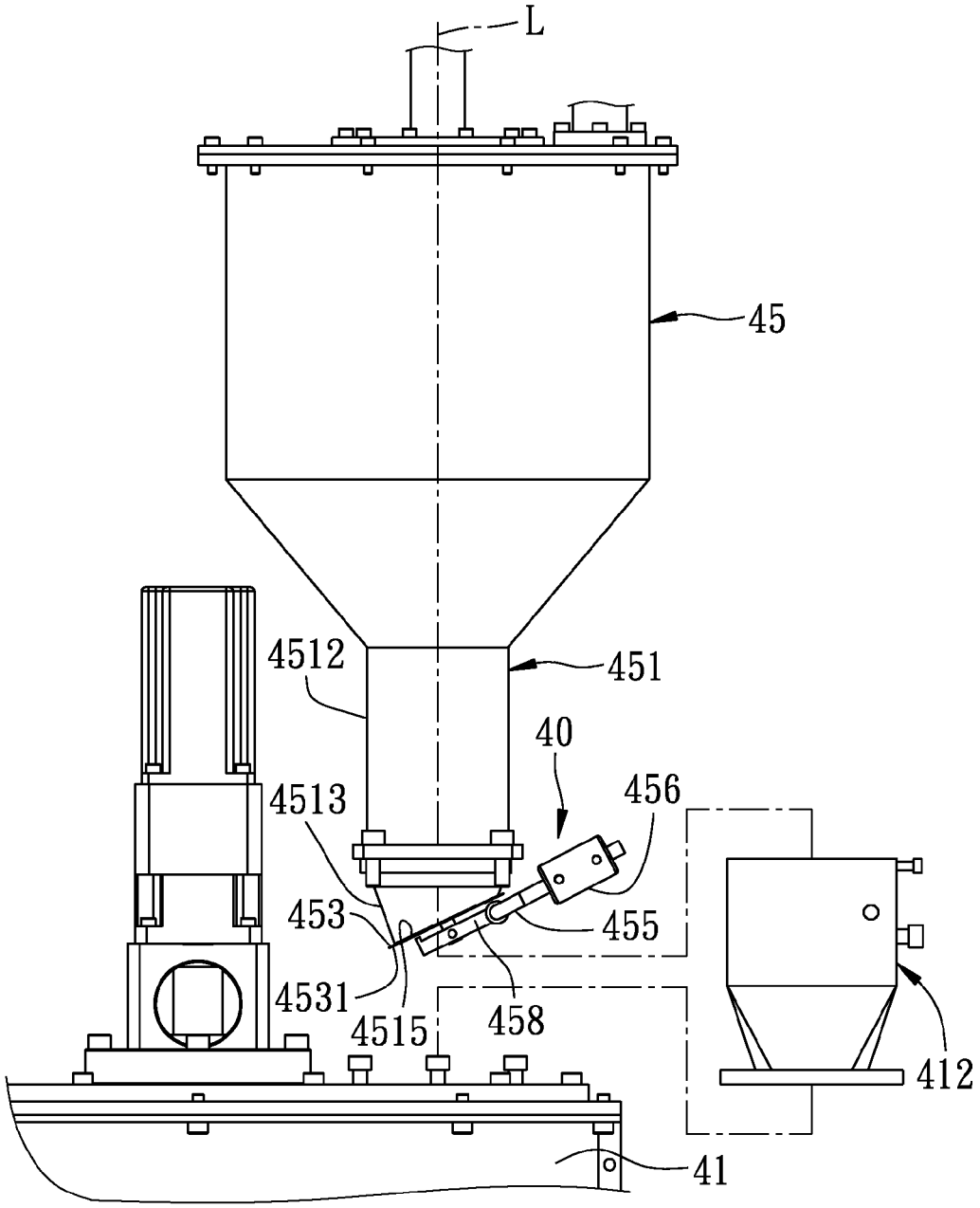
FIG. 8 is a partly exploded side view of an assembly of the preheating funnel, a feed hopper, a material outlet conduit, and a weight-controlling valve mechanism of the preferred embodiment.
Figure 9:
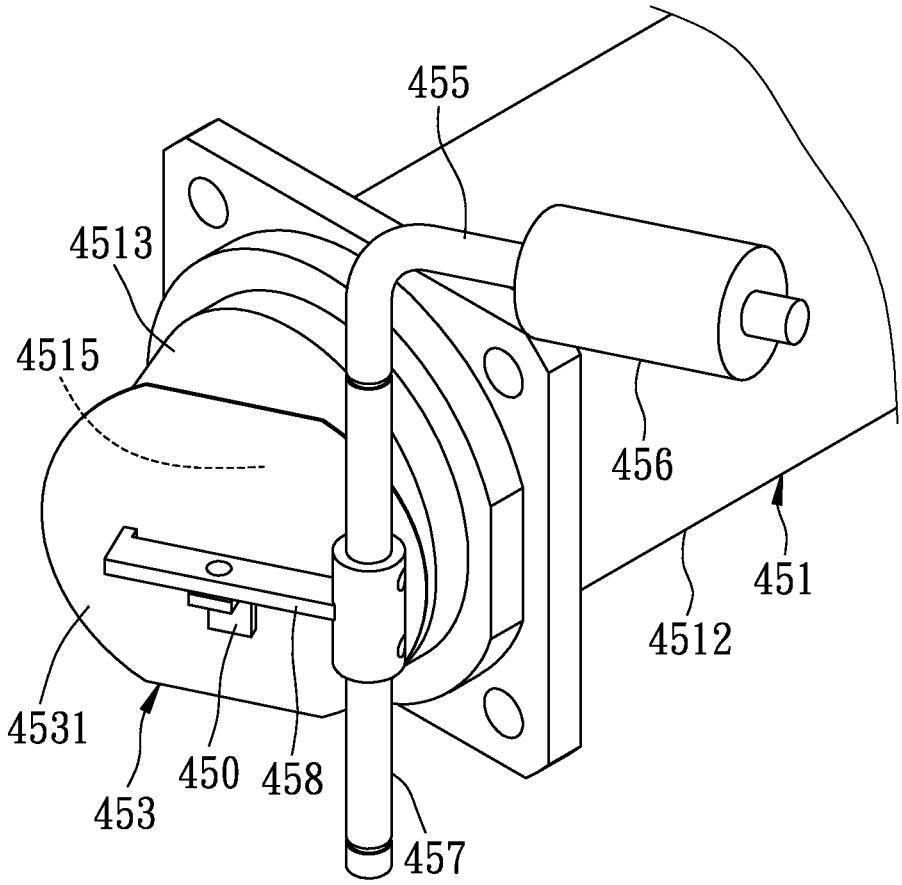
FIG. 9 is a fragmentary perspective view of the assembly of the weight-controlling valve mechanism and the material outlet conduit of the preferred embodiment.

Referring to FIGS. 8 and 9, in combination with FIG. 2, the material outlet conduit 451 interconnects the feed hopper 45 and the inlet port 412, and has an upper segment 4512 and a lower segment 4513. The upper segment 4512 defines a central axis (L). The lower segment 4513 extends downwardly from the upper segment 4512 in an inclined direction relative to the central axis (L), and defines a bottom end opening 4515.

The weight-controlling valve mechanism 40 utilizes the lever principle to control covering and uncovering of the bottom end opening 4515 in the lower segment 4513 of the material outlet conduit 451, and includes a valve plate 453 having a bottom surface 4531, a first linkage 458 connected to the bottom surface 4531 of the valve plate 453 through an angle plate 450, a driving shaft 457 connected to and transverse to the first linkage 458 and pivoted to the inlet port 412, a second linkage 455 connected and transverse to an end of the driving shaft 457, and a weight block 456 connected to the second linkage 455 for providing a downward force acting on the second linkage 455 for driving rotation of the driving shaft 457 together with the first linkage 458 and the valve plate 453 about an axis of the driving shaft 457 in a downward rotational direction so as to rotate the valve plate 453 to a closed position (see FIGS. 8 and 9) to cover the bottom end opening 4515. The valve plate 453 is rotatable together with the first linkage 458, the driving shaft 457, the second linkage 455 and the weight block 456 about the axis of the driving shaft 457 in an upward rotational direction opposite to the downward rotational direction when the weight of the aluminum-based raw material loaded on a top surface of the valve plate 453 overcomes the weight of the weight block 456, thereby uncovering the bottom end opening 4515 (not shown) and permitting passage of the aluminum-based raw material therethrough and into the funnel space 305.

With the inclusion of the scoop member 52, the driving mechanism and the transmission mechanism in the aluminum-based material melting apparatus of this invention, the amount of the aluminum-based melt 90 received in the scoop member 52, which is to be discharged to the casting mold 6, can be controlled. Moreover, with the inclusion of the axial holes 431 in the inlet conduit 43 and the perforated hollow pillars 44 in the preheating funnel 41 in the aluminum-based material melting apparatus of this invention, the purpose of energy saving can be achieved.

While the present invention has been described in connection with what is considered the most practical and preferred embodiment, it is understood that this invention is not limited to the disclosed embodiment but is intended to furnace cover various arrangements included within the spirit and scope of the broadest interpretation and equivalent arrangements.

What is claimed is:

1. An aluminum-based material melting apparatus comprising:

a furnace defining a furnace space and adapted to accommodate an aluminum-based melt in said furnace space;

a melt-discharging conduit having an inner portion disposed in said furnace space, and an outer portion disposed outwardly of said furnace space, said inner portion being adapted to be disposed above a surface of the aluminum-based melt in said furnace space;

a driving mechanism mounted on said furnace and including a plurality of driving motor;

a transmission mechanism connected to said driving mechanism and including a plurality of movable shafts;

a scoop member suspended in said furnace space and driven by said driving mechanism through said transmission mechanism so as to be movable upwardly and downwardly in said furnace space between upper and lower positions and so as to be rotatable relative to said furnace about a first axis between scooping and pouring positions so that said scoop member can scoop the aluminum-based melt when disposed at the lower position and the scooping position and that said scoop member can pour the aluminum-based melt into said inner portion of said melt-discharging conduit when disposed at the upper position and the pouring position;

a preheating funnel disposed above said furnace and defining a funnel space that is adapted to receive an aluminum-based raw material therein;

an inlet conduit interconnecting said preheating funnel and said furnace and defining a central space that is in fluid communication with said funnel space and said furnace space; and a horizontal conveying shaft extending transversely through said inlet conduit, rotatable about its axis relative to said inlet conduit and formed with at least one blade that protrudes therefrom into said central space for conveying the aluminum-based raw material from said central space into said furnace space when said conveying shaft rotates about its axis.

2. The aluminum-based material melting apparatus of claim 1, wherein said transmission mechanism includes first and second shafts that are mounted movably on said furnace and that are coaxially disposed with respect to a second axis which is perpendicular to the first axis, said second shaft being coupled rotatably to said first shaft, said driving mechanism including first and second driving motors, said first driving motor driving co-movement of said first and second shafts along the second axis, said second driving motor driving rotation of said second shaft relative to said first shaft about the second axis, which, in turn, drives rotation of said scoop member relative to said first shaft about the first axis.

3. The aluminum-based material melting apparatus of claim 2, wherein said transmission mechanism further includes a worm secured to said second shaft, a linking shaft secured to said scoop member, and a worm wheel secured to said linking shaft and meshing with said worm for driving rotation of said scoop member about the first axis when said second driving motor is actuated, said first driving motor having an output shaft, said transmission mechanism further including a rack that is secured to said first shaft, and a pinion that is coaxially and securely sleeved on said output shaft and that meshes with said rack for driving upward and downward movement of said first and second shafts when said first driving motor is actuated.

4. The aluminum-based material melting apparatus of claim 1, further comprising at least one perforated hollow pillar, said inlet conduit having an annular upper portion and an annular lower portion that extends downwardly from said upper portion and that is in fluid communication with said furnace space, said upper portion being connected to said preheating funnel, and being formed with at least one axial hole that extends axially along the length of said upper portion and that is in fluid communication with said lower portion and said funnel space for passage of a hot gas from said furnace space therethrough and into said funnel space, said perforated hollow pillar being disposed in said funnel space and extending into said axial hole in said upper portion of said inlet conduit so as to be in fluid communication with said axial hole.

* * * * *